United States Patent [19]

Paquin et al.

[11] Patent Number: 4,928,379

[45] Date of Patent: May 29, 1990

[54] PRESS FOR USE IN ALIGNING AND TERMINATING FLAT CABLE

[75] Inventors: Patrick J. Paquin, Hamden; Robert L. Baran, Plymouth, both of Conn.

[73] Assignee: Amphenol Corporation, Wallingford, Conn.

[21] Appl. No.: 855,253

[22] Filed: Apr. 24, 1986

[51] Int. Cl.[5] ..... H01R 43/01

[52] U.S. Cl. ..... 29/566.3; 29/749

[58] Field of Search ..... 29/564.2, 564.8, 566.3, 29/566.4, 748–750, 752, 754, 755, 760, 564.1, 566.1; 140/1

[56] References Cited

U.S. PATENT DOCUMENTS

| | | | |
|---|---|---|---|
| 3,062,245 | 11/1962 | Liebscher | 140/1 |
| 3,491,426 | 1/1970 | Grassauer | 29/749 |
| 4,035,897 | 7/1977 | Over et al. | 29/749 X |
| 4,534,098 | 8/1985 | Brown et al. | 29/564.8 |
| 4,734,978 | 4/1988 | Nipper et al. | 29/749 |

*Primary Examiner*—Steven C. Bishop
*Attorney, Agent, or Firm*—Bacon & Thomas

[57] ABSTRACT

The invention relates to a unitary cable terminating press for terminating flat cable of the type having multiple individual conductors extending therethrough. This is especially applicable for terminating such cable which is arranged in a twisted configuration defining a cable of substantially round configuration. The press includes a guide and clamp having a plurality of individually operable clamp members for first positioning and clamping a first predetermined portion of the cable in a manner such that the conductors within that portion are clamped in a desired position. Thereafter, additional portions can be selectively clamped by the individual clamp member in a predetermined sequence. A cutting blade then serves to cut the cable at a location relative to the clamp. A flat cable connector can then be positioned in open engagement and a press mechanism is brought down on the connector to terminate the cable with the connector.

4 Claims, 7 Drawing Sheets

PRESS FOR USE IN ALIGNING AND TERMINATING FLAT CABLE

BACKGROUND OF THE INVENTION

This invention relates to a device for holding flat or ribbon cable of the type having a plurality of individual round conductors in a predetermined aligned flat arrangement to facilitate proper termination thereof. The invention further relates to a termination system for cutting the cable after being pressed into position, and then pressing a connector onto the cable. In another aspect the invention relates to a method of aligning such cable in a flat position to facilitate proper termination, and further, to the method of cutting the cable and terminating the cable with a connector.

In the field of microelectronics, and other electronic areas such as in automobile computers, it has been increasingly common to use flat ribbon cable for the purpose of establishing interconnections between personal computers and their various peripheral devices. Flat ribbon cable typically is a cable made up of a plurality of individual round conductors which are each individually insulated, i.e., covered by an insulated sheath, and laid out in a generally flat configuration wherein each conductor is parallel to an adjacent conductor such as to make up a generally flat cable. Termination of such cable is generally made with a multiple socket or pin contact connector which is pressed onto the cable to establish connection. The connector typically includes a plurality of insulation displacement contacts, each one for a respective conductor of the cable such that when the connector is clamped shut onto the end of the cable, electrical connection is established between each of the conductors of the cable and their respective insulation displacement contact of the connector.

In the prior art manual means have typically been provided for aligning the individual conductors of the cable and clamping them down into a predetermined position. Thereafter, a separate tool was employed to clamp the connector onto the end of the cable. Although generally working satisfactorily, this was a time consuming process due to the relatively small size of the individual conductors and the necessity for having precise alignment to ensure that no short circuit results because of misalignment of the insulation displacement contacts of the connectors with respect to the covered conductors of the cable.

A further development in the prior art involved a modification to the discussed flat cable whereby slits were placed in the insulation between respective conductors of flat cable to permit twisting and compacting of the cable throughout its length into a generally round configuration. Such a round configuration was desirable because of its reduced size and in addition, the slit arrangement between conductors of the ribbon cable permits bending and twisting of the cable into any desired configuration, something that was not possible with conventional flat ribbon cable. To hold the cable in a round configuration, an outer insulative sheath was provided. This type of cable is available commercially, for example, from Amphenol Products as Spectra Strip® Round N' Flat® cable.

A result of providing the flat cable in a round configuration is that because it is maintained in a twisted state, it becomes very difficult to align the individual conductors when it is desired to terminate the conductors into correct position with a connector. More specifically, in terminating such cable typically the outer sheath is stripped off at a portion near the end and it then becomes necessary to flatten out the conductors into the original flat configuration prior to twisting and thereafter terminate it with an insulated displacement contact. As a result of the tendency to move back into its round configuration because of the prior twisting, this involves a long and tedious manual process whereby, for example, a single clip member is employed to hold the individual conductors in a flat configuration. Because of the tendency of the cable to move back into its twisted state prior to being clipped, this involves extensive positioning and repositioning the individual conductors until finally they are held in position and held with the clip for later termination with another tool containing a connector of the type having insulation displacement contacts, i.e., IDC connectors, as discussed above.

In accordance with the invention, these problems are obviated and a simple tool and system which permits both alignment and termination of such flat ribbon cable both of the round twisted type as well as conventional non-twisted flat ribbon cable is provided. In addition, the invention also resides in the method of terminating such types of cable.

SUMMARY OF THE INVENTION

In one aspect the invention relates to an improvement in a cable terminating system for terminating flat ribbon cable of the type having multiple individual conductors extending therethrough. The improvement resides in the provision of locating and clamp means having a plurality of clamp portions, at least a first clamp portion being individually operable for positioning and clamping a first predetermined section of the cable in a manner wherein the conductors within said first section are clamped in a desired position, as well as the remaining clamp portions for selectively positioning and clamping, preferably in a sequential manner, the additional predetermined sections of the cable, with the conductors thereof in desired positions whereby termination of the cable can then be easily conducted. The improvement in accordance with the invention is especially applicable for use in terminating a flat ribbon cable of the type having conductors extending therethrough in a twisted substantially round configuration such that it becomes difficult to align such conductors once they have been formed into the twisted configuration.

In another aspect, the invention also comprises cutting means located relative to the locating and clamp means for substantially uniformly cutting off the end of the cable to permit subsequent termination in a connector, and press means for supporting a flat cable connector in open engagement with the cut end of the cable and for pressing closed the connector onto the cut end of the cable whereby the cable is thus terminated. The connector is of the type having insulation displacement type contacts such that when it is pressed closed the insulation displacement contacts respectively establish contact with individual conductors of the cable.

In a more specific aspect, the locating and clamp means comprises a two part member, a first member being a clamp base including a plurality of guide slots for receiving individual conductive portions of a flat cable therein. A second member is a movable clamp member made up of a plurality of individually actuatable spring clamp fingers positioned such that as the clamp member is brought down into engagement with the flat ribbon cable, the first finger first coming into contact with a predetermined size section of the cable and clamping it down into a number of the guide slots on the base. Thereafter as the clamp is brought down further, additional fingers sequentially engage additional predetermined size portions of the cable until finally the entire cable is held by the clamp member having been brought down, and with all of the fingers engaging respective portions of the cable. This permits on a stepwise basis the quick and easy alignment of individual portions of the cable and thereafter, aligning other portions so that conductors of flat ribbon cable can be easily aligned, and in the case of twisted flat ribbon cable, the problem with the cable tending to move back into a twisted configuration is obviated.

In accordance with another aspect of the invention, there is provided an improved cam actuating mechanism for operating the clamp means, press means and cutting means.

In accordance with still another aspect of the invention, there is provided a method of terminating such cable by employing the above-discussed system and device.

BRIEF DESCRIPTION OF THE DRAWINGS

Having briefly described the invention, the same will become better understood from the following detailed discussion, taken in conjunction with the attached drawings wherein.

DETAILED DISCUSSION OF THE INVENTION

Figure 1:
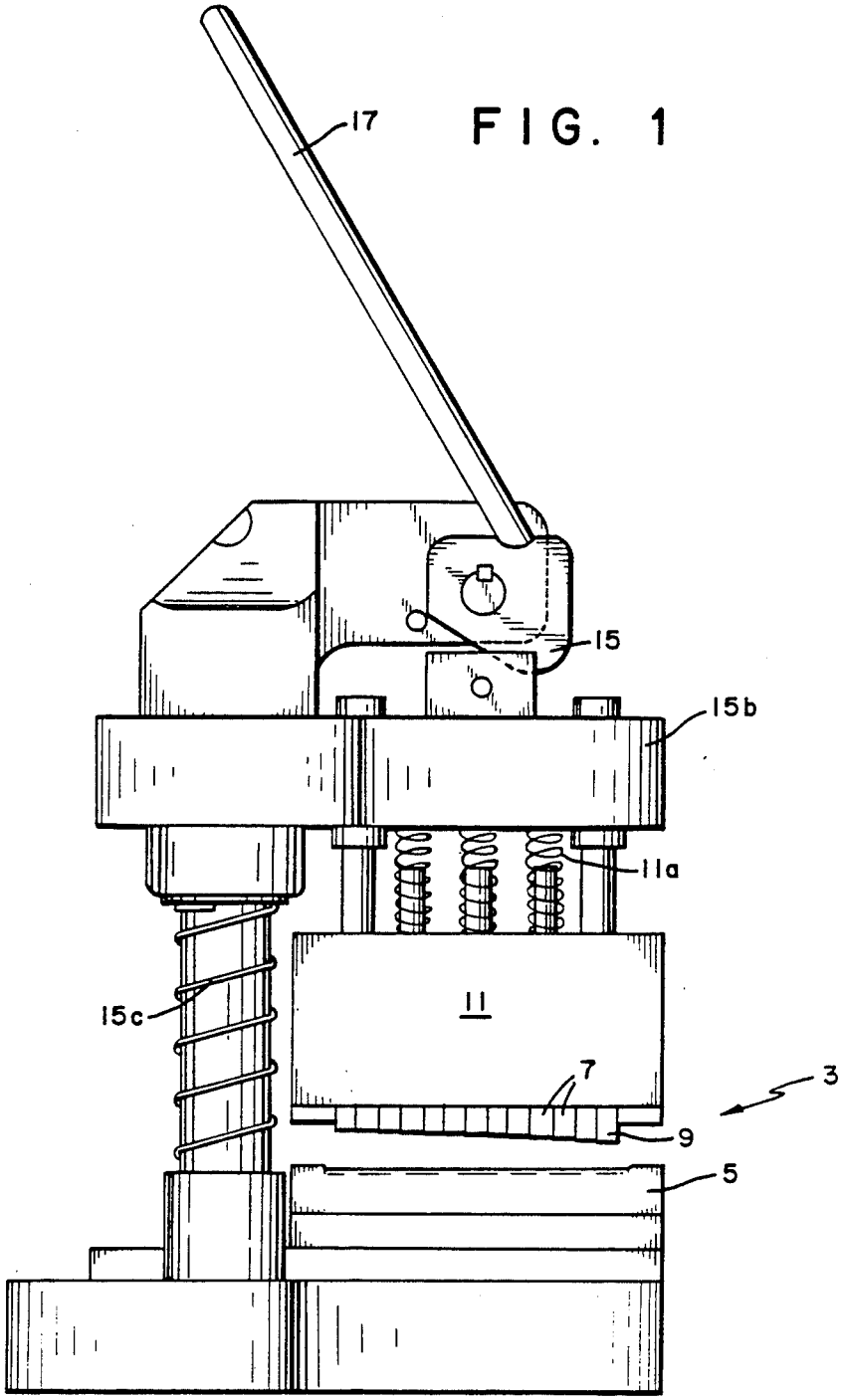
FIG. 1 is an end view from one side of the clamping mechanism in accordance with the invention, illustrating the individual clamp fingers of the clamp member.

In FIG. 1 there is shown the clamp mechanism in accordance with the invention. As can be seen therein, the clamp mechanism 3 includes a base 5, which as clearly seen in FIGS. 2*a*, 2*b* and 35 includes guide slots or teeth 5*a* for receiving individual conductors 24 of a flat cable.

Figure 2B:
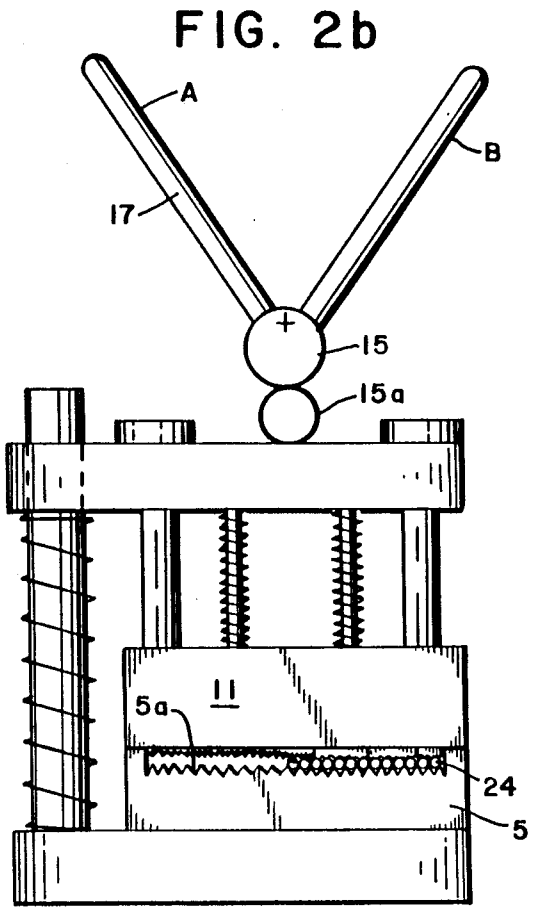
FIGS. 2*a* and 2*b* are schematic views as in FIG. 1 showing the clamp members being brought down onto a flat cable which has been positioned in the individual guides of the base of the clamp.
Figure 2A:
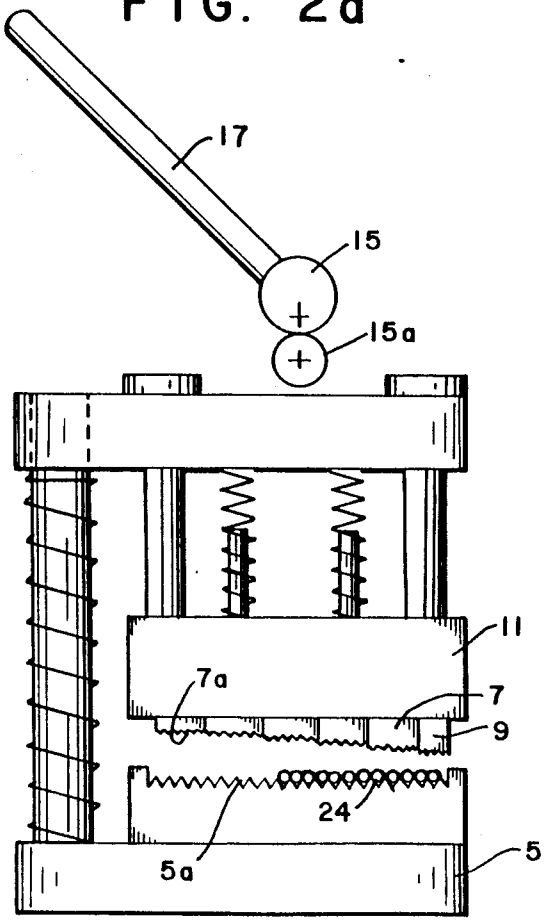
Figure 3:
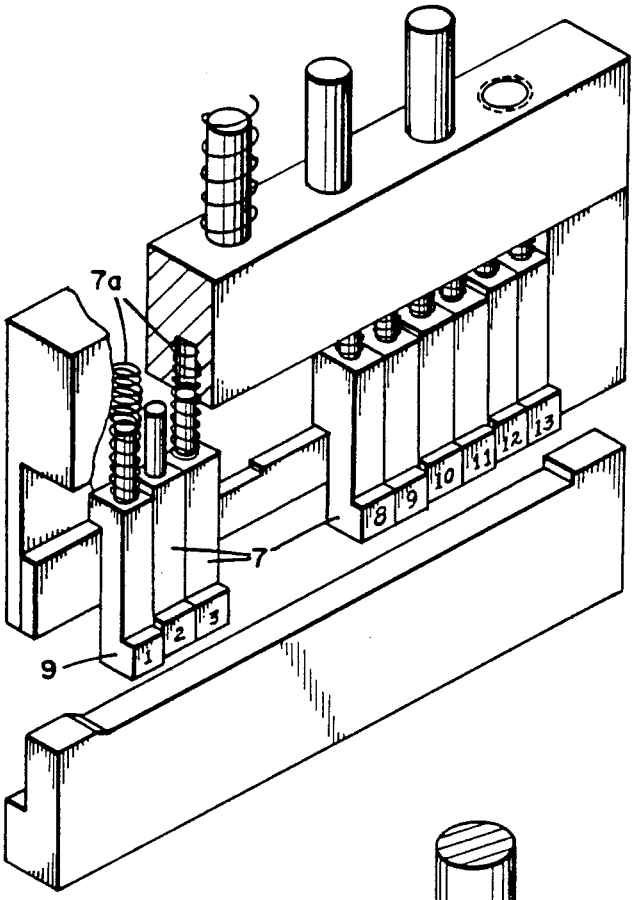
FIG. 3 is a perspective partial view in partial cross-section showing the clamp member and fingers mechanism for holding the individual conductors of the flat cable.

As further shown FIGS. 1 and 3 an upper movable press member 11 includes a plurality press fingers 7 including a first press finger 9 which is located further down in the vertical direction relative to the other press fingers, with the plurality of press fingers 7 being progressively located at 2 higher vertical distance as viewed from right to left FIG. 1. In operation, a lever 17 is pulled to actuate a cam mechanism 15, 15*a* which forces down the top plate 15*b* and clamp 11 which are spring loaded by springs 11*a* and 15*c*, so as to first bring the first press finger 9 into engagement with the individual conductors 24 of a predetermined portion of the cable on the right hand side to hold them in their respective guide slots 5*a*. As also shown in FIGS. 2*a* and 2*b*, the press fingers 7 will preferably have cooperating teeth or guide slots 7*a* which cooperate with guide slots 5*a* to hold the individual conductors in place. As the lever 17 is moved further, and manipulating the cable small sections at a time, an additional press finger 7 is brought down to hold the next section and so on to thereby properly align the flat cable and lock it in place. In this regard, it is noted that the press fingers 7 are spring loaded with springs 7*a* within press members 11 which is in turn spring loaded by springs 11*a* to upper plate 15*b*. The spring loading of the fingers 7 is to permit the progressive clamping motion of the individual fingers 7. Springs 11*a* compensate for any over clamping due to over rotation of lever 17. In addition, they also compensate for further downward movement of plate 15*b* to be effected later for termination purposes as discussed hereafter.

Figure 7:
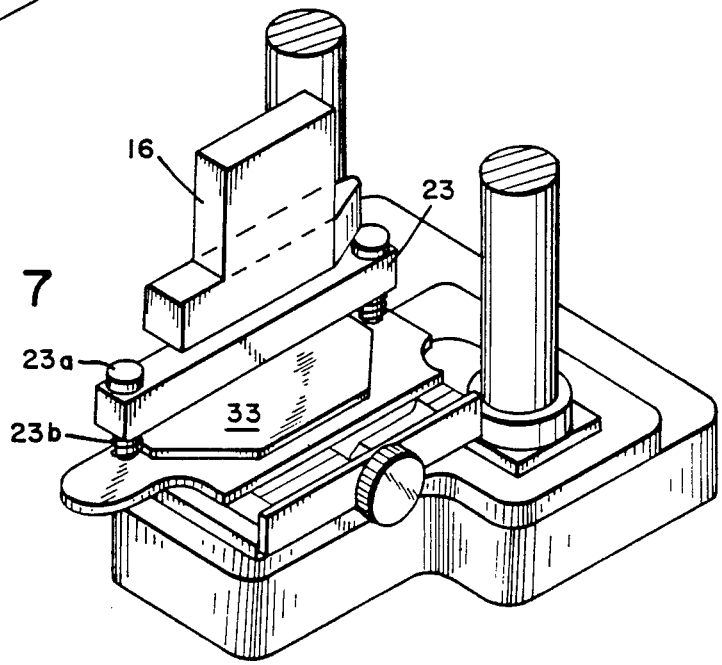
FIG. 7 is a partial view in perspective of the cutting mechanism of the invention.
Figure 6:
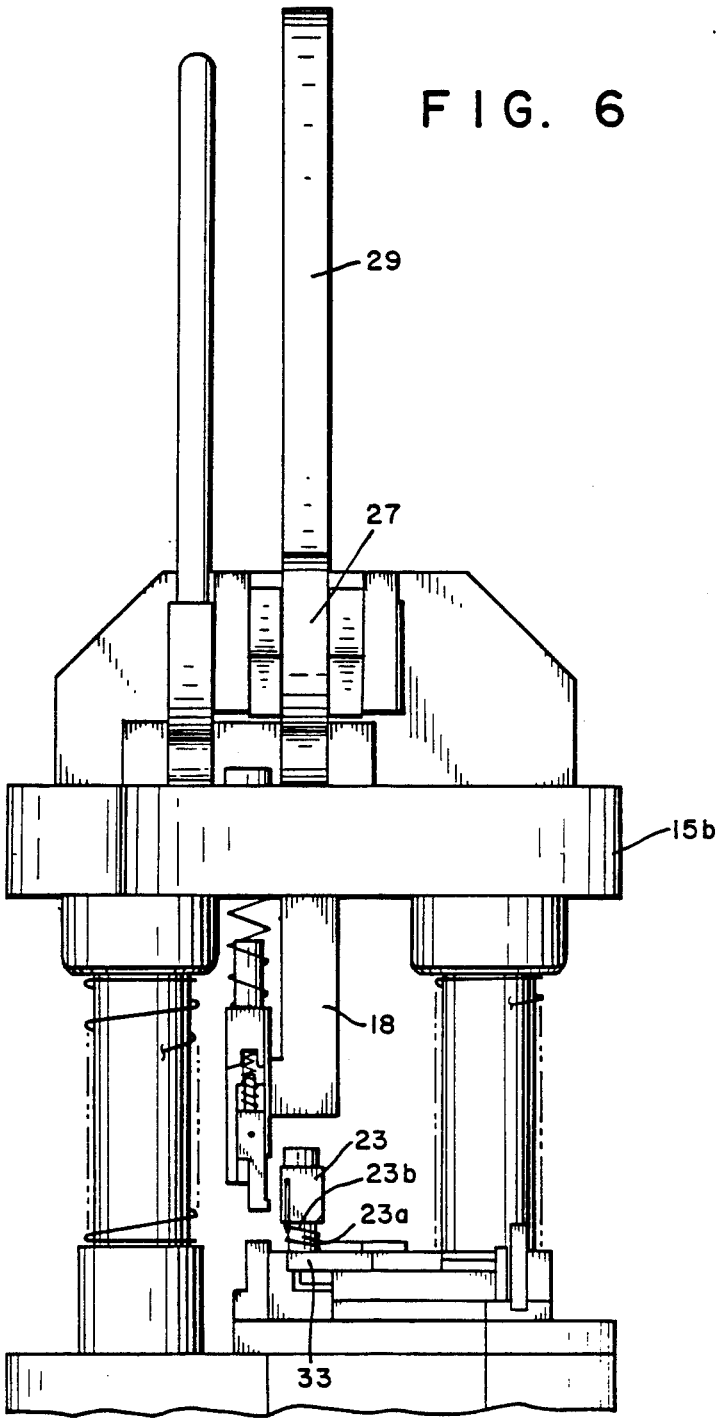
FIG. 6 is a view from the front of the device in accordance with the invention, illustrating, in partial cross section the first clamp member, a second press member which serves to engage a cutting blade as well as for clamping closed a connector onto the end of a cable to be terminated with the tool.

Thereafter, as shown in FIG. 6, a second lever 29 is pulled forward to actuate a cam mechanism 27 to further force top plate 15*b* downwardly to press a downwardly extending member 18 onto knife blade member 23, which is spring loaded upwardly on rods 23*a* by springs 23*b*, to force it onto the cable to cut it at a predetermined portion. The blade 23 cuts through the cable and impinges upon a base 33. The blade 23/base 33 mechanism is more clearly shown in FIG. 7.

Figure 4:
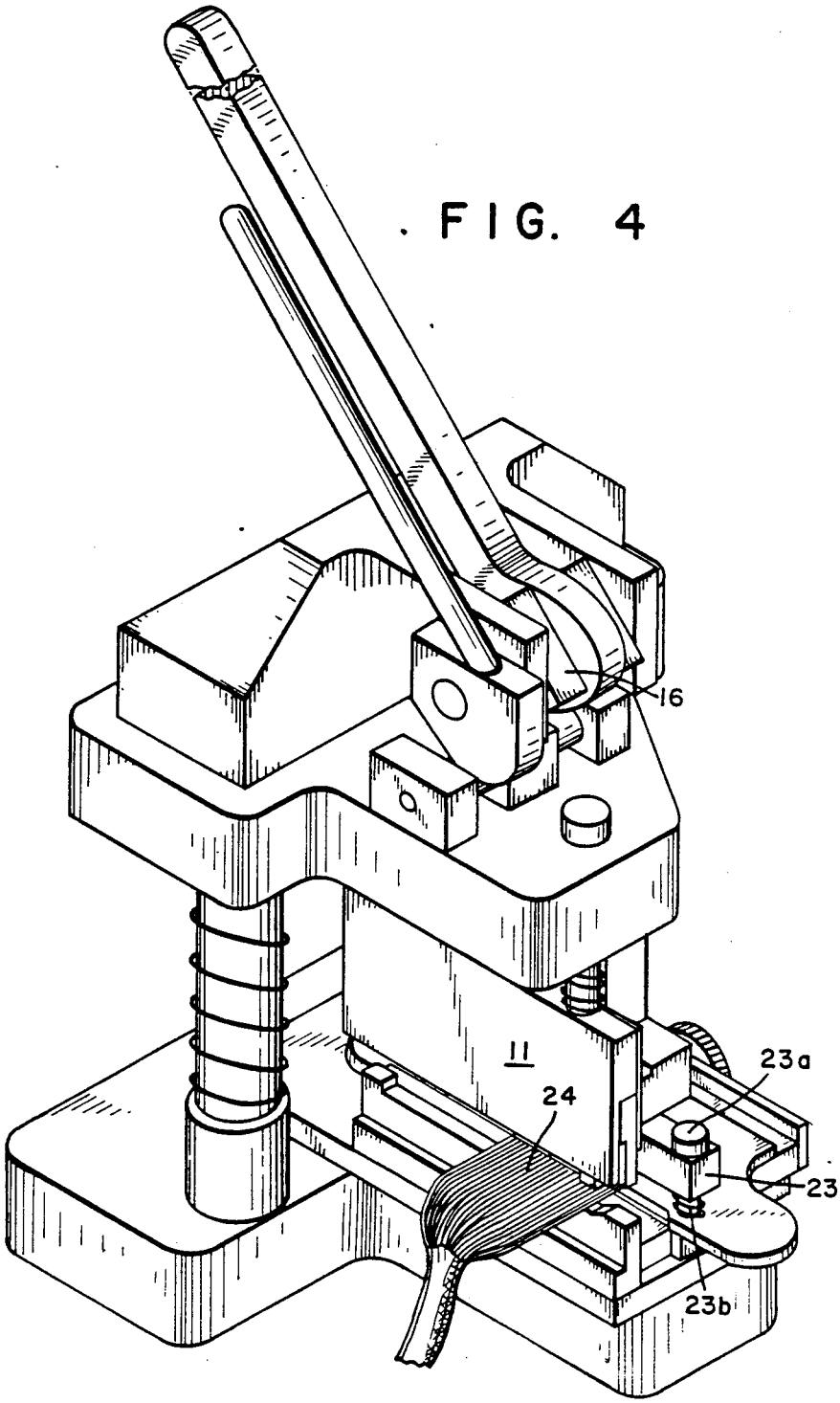
FIG. 4 is a perspective view from the top of the device showing the dual cam actuating mechanism thereof.
Figure 5A:
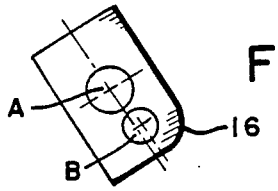
FIGS. 5*a*, 5*b*, 5*c*, and 5*d* show the sequential operation of the dual cam mechanism of the invention.
Figure 5B:
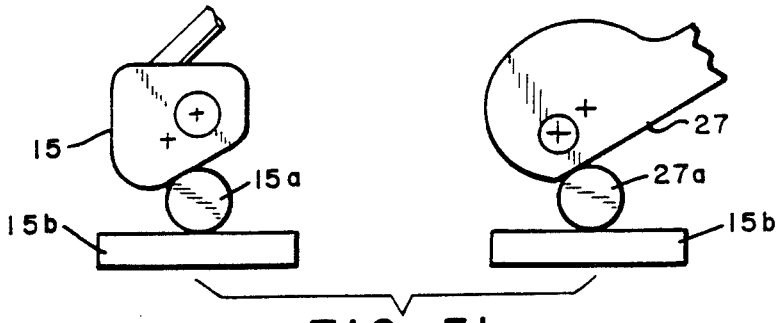
Figure 5C:
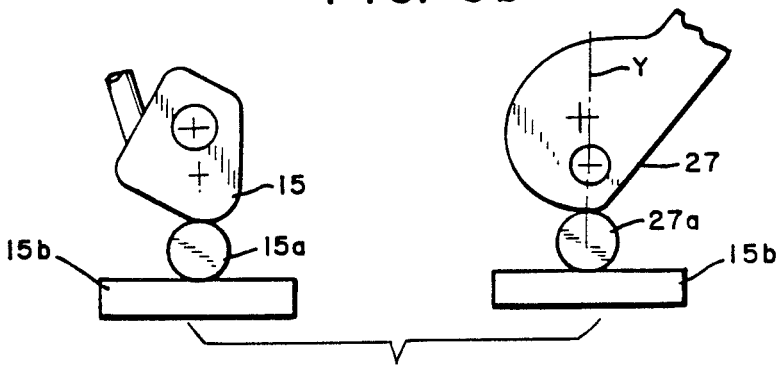
Figure 5D:
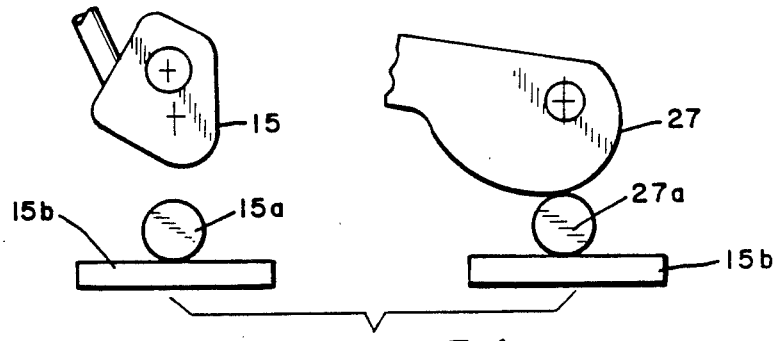

With respect to the cam mechanism, of the device, this is more clearly shown in FIG. 4 and the operation thereof illustrated in sequence in FIGS. 5*a*–5*d*. More specifically, the two pivot points of the levers 17 and 27 are shown in FIG. 5*a* as connected through member 16 in FIG. 4. As lever 17 is pulled forward, cam 15 rotates about pivot point A, as shown in FIGS. 5*a* on crank arm 16, and FIGS. 5*b*, 5*c* on the left hand side.

This results in follower 15*a* pushed down with plate 15*b* into a cable locked and clamped position due to the cam structure shown. Simultaneously, cam 27 pivot point B has been rotated into its operating location. This location is critical for two reasons. The first is that by bringing the pivot point B closer to the cam follower 27*a* center line, the base radius of the cam 27 can be made smaller, which in turn minimizes the power required to operate cam 27. Secondly, because pivot point B ends up behind pivot point A, pressure against cam 27 upwardly in the vertical direction y causes the cable locking cam 15 to remain in the cable locked or clamped position while cutting or termination occurs. At this time, due to the further downward movement of plate 15*b*, the cam 15 is separated from follower 15*a*. The combined cams 15 and 27 arrangement is better viewed in FIG. 4.

Figure 8:
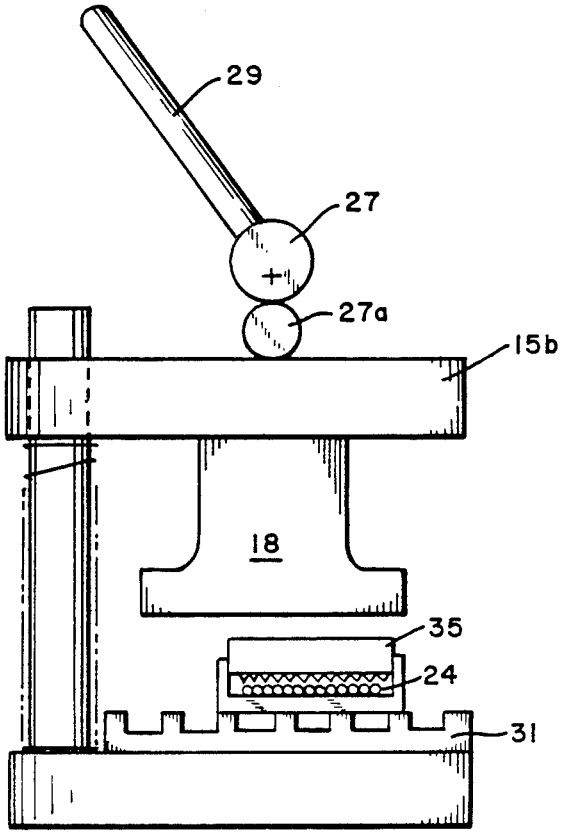
FIG. 8 is a schematic end view from the side opposite FIG. 1 showing a connector with insulation displacement contacts in position for being clamped to terminate the cable.

After the cable has been properly cut for termination, the blade member 23 is swung a side and a connector 35 in its open position and having insulation displacement contacts 37 is mounted on a tool mount 31 in open engagement with the end of the cable. The lever 29 is again pulled to actuate the cam mechanism 27 to bring down the press 18 and force the connector 35 closed to thereby terminate and establish electrical contact with the respective conductors 23 of the cable. This action is clearly shown on FIG. 8.

It is noted that the tool 31 support is interchangeable to accommodate different size connectors as will be readily apparent to those of ordinary skill in the art. Furthermore, with respect to the cutting mechanism, although traditionally Plexiglass® bases have been employed, in order to simplify the construction of the device, a base 33 is made of a soft metal such as brass. This is clearly shown in FIG. 7. This permits a complete follow through of the blade in cutting the cable with the blade projecting somewhat into the soft metal due to its soft nature. As a result, the cam mechanism 27 and lever 29 need not have a predetermined stop and the construction thereof is thus simplified.

Having described the invention in detail, it will become readily apparent that various other equivalent constructions can be employed, and not intending to be limitative in any way whatsoever, the following claims define what applicant considers to be the invention.

What is claimed:

1. A cable terminating press for terminating flat cable of the type having multiple individual conductors extending therethrough, said press comprising:

locating and clamp means having at least two clamp portions, at least one clamp portion being individually operable for first positioning and clamping a first predetermined portion of said cable in a manner wherein the conductors within said portion are clamped in a desired position, and for subsequently selectively clamping additional predetermined portions of said cable with conductors thereof in desired positions;

cable cutting means located relative to said locating and clamp means for substantially uniformly cutting off the end of the cable to permit subsequent termination in a connector, said cable cutting means comprising an upwardly spring braced blade moveable between a first cutting position for cutting cable and a second non-cutting position for permitting said press means to terminate the cable with a connector; and press means for supporting a flat cable connector in open engagement with the cut end of the cable and for pressing closed said connector onto the cut end of the cable whereby the cable is terminated.

2. A press as in claim 1 wherein said at least one individual clamp portion is a plurality of individually operable clamp portions.

3. A press as in claim 2 wherein said clamp portions are individual fingers spring loaded within a clamp member to permit sequential clamping of predetermined portions of the cable as the clamp member is progressively brought down on the cable.

4. A press as in claim 1 wherein said clamp means and press means are actuated by a coextensive interconnected dual cam structure having pivot points offset with respect to each other such that actuating one of the dual cams of the structure brings the other into operable position.

* * * * *